US005093690A

United States Patent [19]

Ohno et al.

[11] Patent Number: 5,093,690

[45] Date of Patent: Mar. 3, 1992

[54] PAPER REFEEDING DEVICE FOR A COPIER OPERABLE IN A TWO-SIDED COPY MODE FOR REFEEDING PAPER SHEETS FROM AN INTERMEDIATE TRAY

[75] Inventors: Yukihiro Ohno, Tokyo; Fumiaki Tsuchiya, Nakatsugawa, both of Japan

[73] Assignee: Ricoh Company, Ltd., Tokyo, Japan

[21] Appl. No.: 622,646

[22] Filed: Dec. 5, 1990

[30] Foreign Application Priority Data

| | | | |
|---|---|---|---|
| Dec. 6, 1989 | [JP] | Japan | 1-140629[U] |
| Dec. 26, 1989 | [JP] | Japan | 1-148722[U] |
| Dec. 29, 1989 | [JP] | Japan | 1-151863[U ] |
| Oct. 11, 1990 | [JP] | Japan | 2-270500 |

[51] Int. Cl.[5] ..... G03G 21/00

[52] U.S. Cl. ..... 355/319; 271/3.1; 271/184; 271/225; 355/321

[58] Field of Search ..... 355/308, 309, 319, 321, 355/317, 24, 318; 271/902, 225, 184, 3.1, 258, 186, 4, 291

[56] References Cited

U.S. PATENT DOCUMENTS

| | | | |
|---|---|---|---|
| 4,884,110 | 11/1989 | Tsurubuchi et al. | 355/319 |
| 4,916,493 | 4/1990 | DeVito | 355/321 |
| 4,924,275 | 5/1990 | Nelson | 355/319 |
| 4,956,678 | 9/1990 | Kiya et al. | 355/319 X |
| 4,978,111 | 12/1990 | Kosugi et al. | 355/319 X |
| 5,014,976 | 5/1991 | Muck et al. | 271/902 |

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

A paper refeeding device incorporated in a copier for stacking one-sided paper sheets each carrying an image on one side thereof on an intermediate tray and then refeeding the paper sheets from the tray for forming an image on the other side thereof. In a two-sided copy mode operation, the device reduces the copying time while eliminating paper jam, missfeed and other troubles. The device stacks one-sided paper sheets stably on the intermediate tray and refeeds them without any skew. In addition, the device is simple in construction and implements automatic timing control.

5 Claims, 15 Drawing Sheets

PAPER REFEEDING DEVICE FOR A COPIER OPERABLE IN A TWO-SIDED COPY MODE FOR REFEEDING PAPER SHEETS FROM AN INTERMEDIATE TRAY

BACKGROUND OF THE INVENTION

The present invention relates to a device incorporated in a copier operable in a two-sided copy mode for refeeding one-sided copy sheets each carrying an image on one side thereof from an intermediate tray.

A copier operable in a two-sided copy mode for reproducing images on both sides of a paper sheet is extensively used today. This type of copier has a paper refeeding device for stacking one-sided copy sheets on an intermediate tray and then feeding them again to an image transfer station. While various kinds of paper refeeding devices have been proposed in the past, they cannot refeed copy sheets stably at all times due to incomplete stacking of copy sheets on the intermediate tray, paper jams, refeed errors, etc. Such a problem cannot be dealt with without consuming extra time and, therefore, increasing the overall copying time.

SUMMARY OF THE INVENTION

It is therefore an object of the present invention to provide a paper refeeding device for a copier which reduces the copying time in a two-side copy mode.

It is another object of the present invention to provide a paper refeeding device for a copier which is free from paper jams, refeed errors and other troubles.

It is another object of the present invention to provide a paper refeeding device for a copier which stacks paper sheets stably on an intermediate tray and refeeds them stably without any skew.

It is another object of the present invention to provide a paper refeeding device for a copier which is simple in construction and, yet, allows the timings thereof to be automatically controlled.

It is another object of the present invention to provide a generally improved paper refeeding device for a copier operable in a two-sided copy mode.

In accordance with the present invention, a paper refeeding device for a copier operable in a two-sided copy mode comprises an intermediate tray for stacking one-sided paper sheets each carrying an image on one side thereof, a feed roller selectively rotatable in a direction for driving one-sided paper sheets into the intermediate tray and a direction for driving the one-sided paper sheets out of the intermediate tray, a separator roller contacting the feed roller, and a sensor for sensing, when images are to be produced on both sides of a single paper sheet, the single paper sheet being driven into the intermediate tray and then generating a signal which causes the feed roller and separator roller to stop driving the paper sheet while nipping the trailing edge of the paper sheet therebetween.

Also, in accordance with the present invention, a paper refeeding device for a copier operable in a two-sided copy mode comprises an intermediate tray for stacking one-sided paper sheets each carrying an image on one side thereof, a feed roller selectively rotatable in a direction for driving one-sided paper sheets into the intermediate tray and a direction for driving the one-sided paper sheets out of the intermediate tray, a separator roller contacting the feed roller, and a sensor for sensing, when images are to be reproduced on both sides of a plurality of paper sheets, sensing the last paper sheet to be driven into the intermediate tray and then generating a signal which causes the feed roller and separator roller to stop driving the last paper sheet while nipping the trailing edge of the last paper sheet therebetween.

Further, in accordance with the present invention, a paper refeeding device for a copier operable in a two-sided copy mode comprises an intermediate tray for stacking one-sided paper sheets each carrying an image on one side thereof, a feed roller selectively rotatable in a direction for driving one-sided paper sheets into the intermediate tray and a direction for driving the one-sided paper sheets out of the intermediate tray, a guide plate located in close proximity to the feed roller, and a separator roller having the axis thereof located closer to the intermediate tray than a perpendicular extending from the axis of the feed roller to the guide plate and being held in contact with the feed roller.

Furthermore, in accordance with the present invention, a paper refeeding device for a copier operable in a two-sided copy mode comprises an intermediate tray for stacking one-sided paper sheets each carrying an image on one side thereof, a feed roller selectively rotatable in a direction for driving one-sided paper sheets into the intermediate tray and a direction for driving the one-sided paper sheets out of the intermediate tray, and a paper pressing member rotatably disposed above the intermediate tray and having a rotatable pressing portion for pressing the trailing edge of a one-sided paper sheet driven into the intermediate tray.

Yet, in accordance with the present invention, a paper refeeding device for a copier operable in a two-sided copy mode comprises an intermediate tray for stacking one-sided paper sheets each carrying an image on one side thereof, a feed roller selectively rotatable in a direction for driving one-sided paper sheets into the intermediate tray and a direction for driving the one-sided paper sheets out of the intermediate tray by using the center of each of the one-sided paper sheets as a reference, a separating roller contacting the feed roller, and auxiliary rollers arranged in a symmetrical relation with respect to the feed roller and reversibly rotatable in association with the feed roller. A line interconnecting the axes of the feed roller and separator roller is inclined such that a one-sided paper sheet is directed substantially downwardly into the intermediate tray and, in the event of refeed, separated from the other one-sided paper sheets with an upper portion thereof contacting the feed roller. A guide member faces the feed roller and auxiliary rollers which are located at opposite ends. The guide member urges the leading edge of a one-sided paper sheet upward when the one-sided paper sheet is driven into the intermediate tray.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, a reference will be made to a conventional copier of the type to which the present invention pertains and a paper refeeding device built therein.

Figure 1:
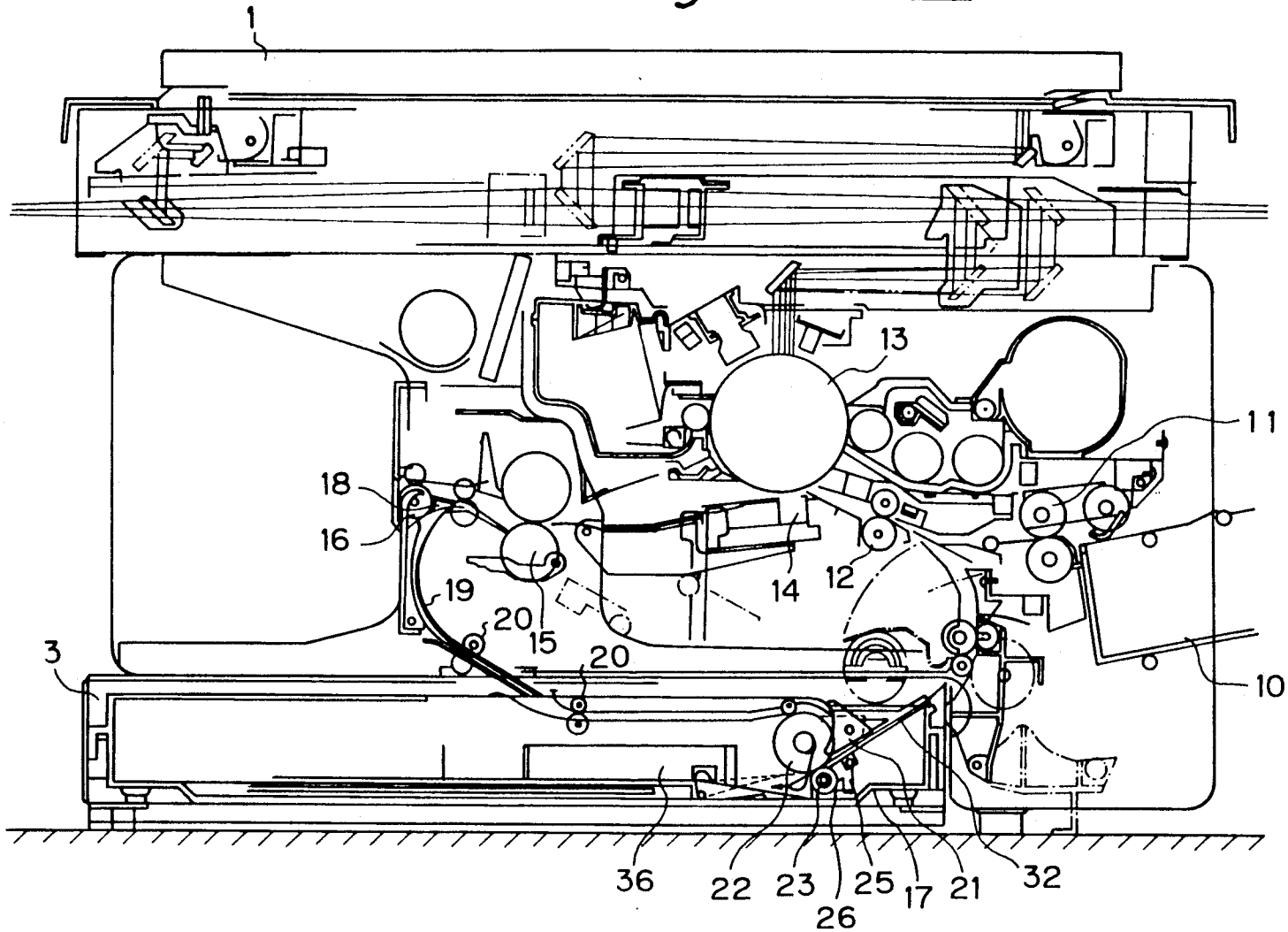
Fig. 1 PRIOR ART
FIG. 1 is a view of a conventional copier to which the present invention is applicable.
Figure 2:
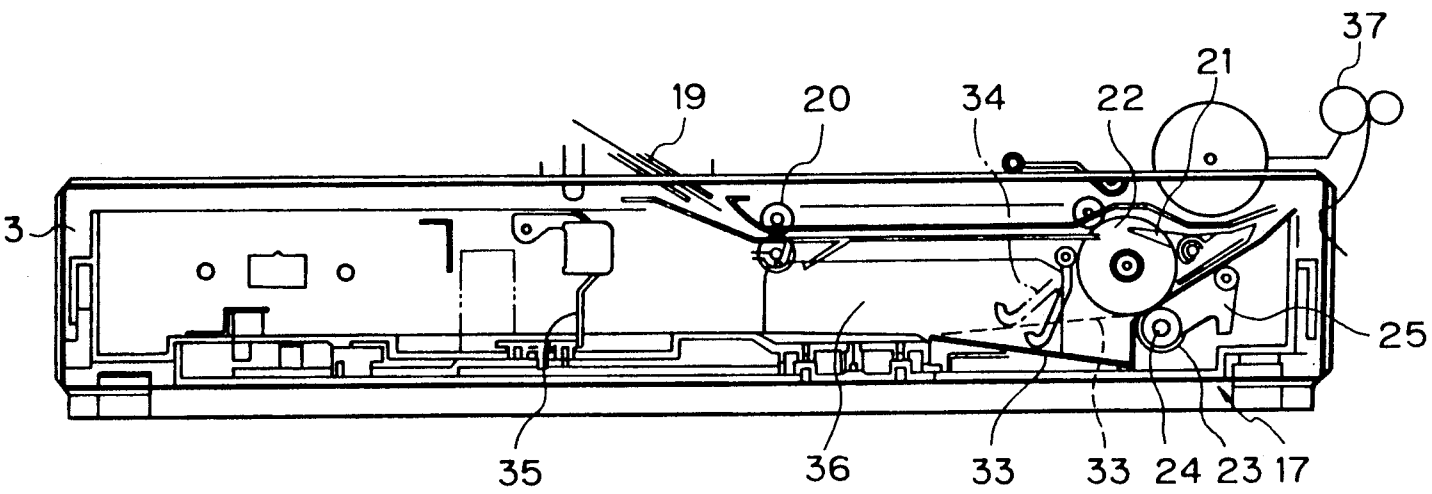
Fig. 2 PRIOR ART
FIG. 2 is a view of a paper refeeding device incorporated in the copier of FIG. 1.

Referring to FIG. 1 of the drawings, a conventional copier has a body 1, a selector in the form of a pawl 18, and a paper refeeding device 3 having an intermediate tray 17 and a feed roller 22. When a paper sheet carrying an image on one side thereof, or one-sided copy sheet, is steered by the selector 18 toward the refeeding device 3, it is transported along a predetermined path 19, through the conveyor rollers 20, and then driven by the feed roller 22 into the intermediate tray 17. As shown in FIG. 2, a presser plate 35 and a side plate 36 cooperate to position the copy sheet on the intermediate tray 17. To refeed such one-sided paper sheets sequentially stacked on the tray 17, a bottom plate 33 is raised to urge the paper stack against the feed roller 22. In this condition, a separator roller 23 is driven to feed out the paper sheets one by one to an image transfer station.

Figure 3:
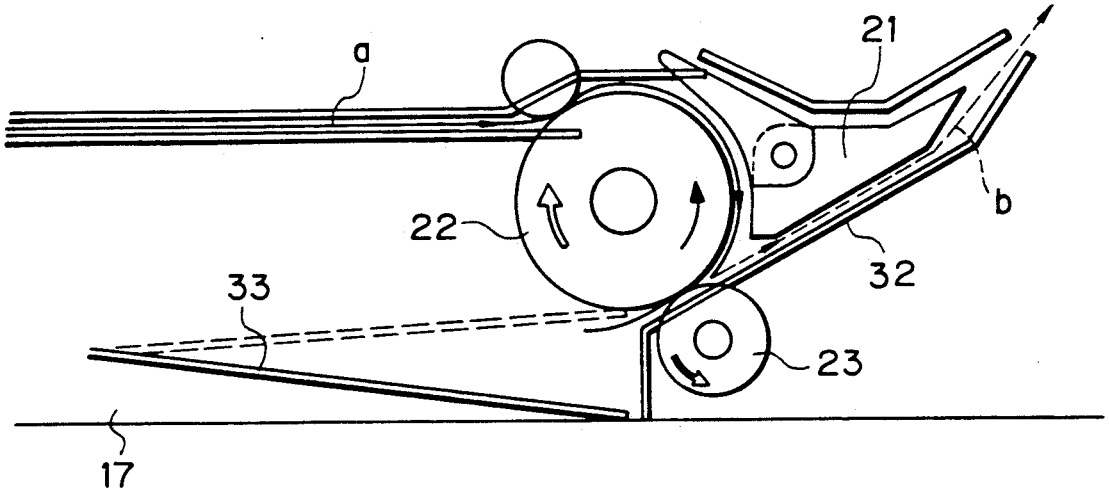
Fig. 3 PRIOR ART
FIG. 3 is a fragmentary enlarged view showing a feed roller included in the conventional refeeding device, together with elements associated therewith.

FIG. 3 shows the feed roller 22 and its associated elements in detail. To drive a one-sided paper sheet into the intermediate tray 17, the feed roller 22 is rotated clockwise as indicated by a blank arrow to move the sheet in a direction $\alpha$. At this instant, the separator roller 23 simply follows the rotation of the feed roller 22, as indicated by a blank arrow in the figure. In the event of refeed, the feed roller 22 is rotated counterclockwise as indicated by a solid arrow to move the paper sheet in a direction indicated by a dashed arrow b. While the feed roller 22 is so rotated, the separator roller 23 is prevented from rotating due to the operation of a one-way clutch associated therewith. As a result, the paper sheets are fed out one by one from the intermediate tray 17. An upper guide 21 and a lower guide 32 are so positioned as to define a refeed path.

As stated above, to reproduce an image on the other side of a one-sided paper sheet, there is executed the following sequence of steps:

(1) driving the paper sheet into the intermediate tray 17 by the rollers 22 and 23 (at this time, the bottom plate 33 remains in a lowered position);

(2) positioning the paper sheet by the presser plate 35 and side plate 36 (with the bottom plate 33 still remaining in the lowered position);

(3) raising the bottom plate 33 to urge the paper sheet against the feed roller 22; and (4) feeding out the paper sheet by the feed roller 22 and separator roller 23.

Figure 4:
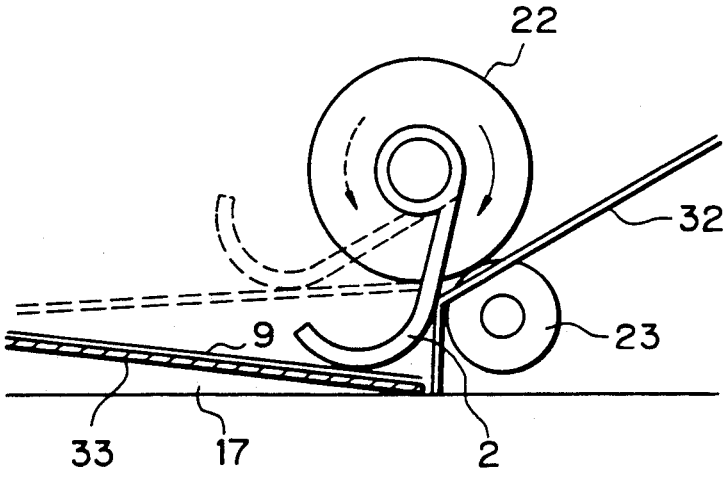
Fig. 4 PRIOR ART
FIG. 4 is a view showing a conventional paper pressing member and its associated elements.

Generally, a one-sided paper sheet coming out of a fixing station is apt to curl. When a paper sheet with a curl is driven into the intermediate tray 17, the trailing edge thereof lifts itself and is apt to catch the leading edge of the following copy sheet. This often results in a paper jam or misfeed in the event of refeed. FIG. 4 shows a paper pressing member 2 customarily incorporated in the device 3 and rotatably mounted on a feed roller shaft or an extra support shaft for pressing paper sheets from above. In FIG. 4, the paper pressing member 2 is rotatably mounted on a shaft on which the feed roller 22 is mounted and has a curved free end. Further, in the conventional copier, it is likely that the leading edge of a one-sided paper sheet to be stacked on the tray 17 fails to get away from the feed roller pair and is caught by the guide. Then, the trailing edge of such a paper sheet also catches the leading edge of the next copy sheet, resulting in incomplete stacking.

Japanese Patent Laid-Open Publication No. 154541/1988 discloses an implementation for eliminating the above problems, as will be described with reference to FIGS. 5 to 8. As shown in the figures, the feed roller 22 is mounted on a shaft A at substantially the intermediate between opposite ends of the shaft A. The separator roller 23 is mounted on an arm, not shown, and pressed against the feed roller 22. A line interconnecting the axes of the rollers 22 and 23 is inclined. A drive mechanism, not shown, is associated with the separator roller 23. This roller 23 follows the rotation of the feed roller 22 during stacking operation, as indicated by an arrow in FIG. 5, but it rotates in the opposite direction during refeeding operation as driven by the drive mechanism. Auxiliary rollers 4 are also mounted on the shaft A and in a symmetrical arrangement at opposite sides of the feed roller 22. The auxiliary rollers 4 each has a smaller diameter than the feed roller 22. An elastic piece 6 is affixed to the guide 32. The bottom plate 33 of the intermediate tray 17 is movable upward to urge a paper stack against the feed roller 22 and thereby generates a feed pressure.

In operation, a one-sided paper sheet transported along a path 9 toward the feed roller 22 is driven into the intermediate tray 17 by the roller 22 and the coactive separator roller 23. The separator roller 23 is located outside of a wall 7a forming part of the intermediate tray 17. Hence, the transporting force exerted by the rollers 22 and 23 does not extend beyond the position where they contact each other, and this position is located outside of the wall 7a. The paper sheet is further driven to between the feed roller 22 and the tip 6a of the elastic piece 6 which abuts against the roller 22, the elastic piece 6 urging the paper sheet against the roller 22. Since the tip 6a of the elastic piece 6 is positioned inside of the wall 7a, the copy sheet is surely fed into the tray 17.

The operation stated above is executed in a two-side copy mode and in a composite copy mode. The paper sheets are stacked face up on the intermediate tray 17.

Figure 5:
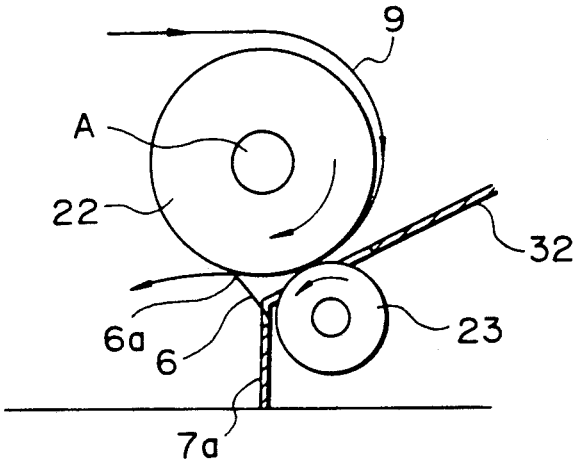
Fig. 5 PRIOR ART
FIG. 5 is a vertical section showing a feed roller and its associated elements.

The paper sheets are refed from the intermediate tray 17 by the following procedure. Referring again to FIGS. 1 and 2, the paper stack on the tray 17 is urged against the feed roller 22 by the bottom plate 33. At the same time, a motor associated with the feed roller 22 is reversed to rotate the roller 22 counterclockwise. The separator roller 23 is rotated in a direction for blocking the paper sheets being urged by the feed roller 22, i.e., counterclockwise in FIG. 5 due to the slipping torque of a clutch spring. As a result, although the roller 22 urges the paper sheets outward, the roller 23 prevents a plurality of copy sheets from being fed out at the same time. At this instant, the tip 6a of the elastic piece 6 is positioned outside of the wall 7a of the tray 17 due to the rotation of the roller 22, as shown in FIG. 5. In this position, the piece 6 does not obstruct the paper sheet being fed out from the tray 17.

A drawback with the prior art device described above is that continuous operations in the two-sided copy mode involve a wasteful time which is not related to the essential part of a copying process. Specifically, the presser plate 35 and side plate 36 have to be moved back and forth for each paper sheet (previously mentioned step (2)), and the bottom plate 33 has to be raised (previously mentioned step (3)).

Figure 9:
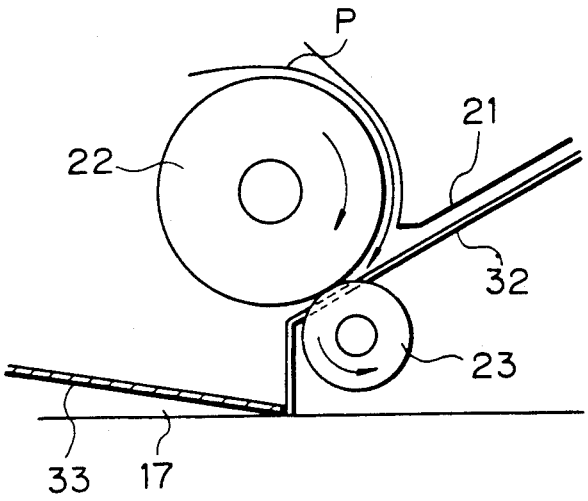
Fig. 9 PRIOR ART
FIGS. 9 and 10 are views demonstrating drawbacks to the prior art that occur in the event of stacking and refeeding, respectively.
Figure 10:
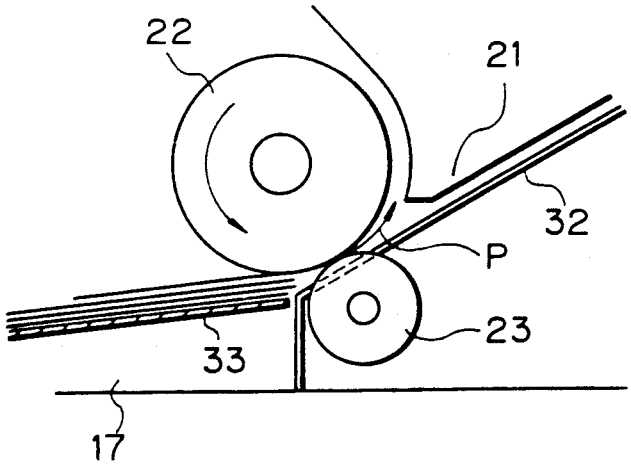
Fig. 10 PRIOR ART

Referring to FIGS. 9 and 10, other troubles particular to the above-stated prior art device will be described. As shown in FIG. 9, to drive a paper sheet P into the intermediate tray 17, the feed roller 22 reverses the direction of transport. Hence, when the paper sheet P has a substantial thickness and, therefore, substantial elasticity, it tends to spring back outward away from the feed roller 22. Then, the leading edge of the sheet P abuts against the separator roller 23 that protrudes from the guide 32, whereby the sheet P is caused to slip. When a plurality of copies are to be produced in succession, the slippage of the copy sheet P would disturb the distance between the successive copy sheets and, in the worst case, reduce it to zero. This causes a paper jam or, when the length and distance of paper sheets are sensed to control the copying procedure, affects the control. On the other hand, assume that the paper sheet P to be refed from the intermediate tray 17 lifts itself by a substantial amount at the leading edge thereof, as shown in FIG. 10. Then, the leading edge of the sheet P fails to enter the transport path extending toward an image transfer station and abuts against the upper guide 21, again resulting in a paper jam.

Figure 6:
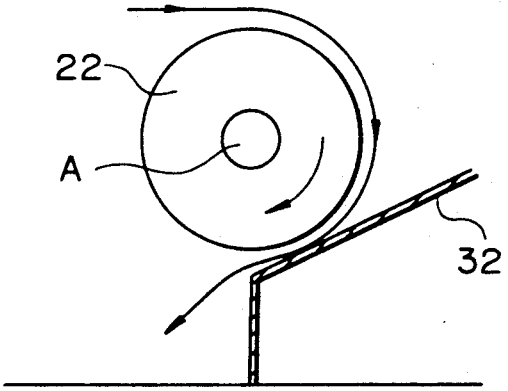
Fig. 6 PRIOR ART
FIG. 6 is a vertical section showing an auxiliary roller arrangement.
Figure 7:
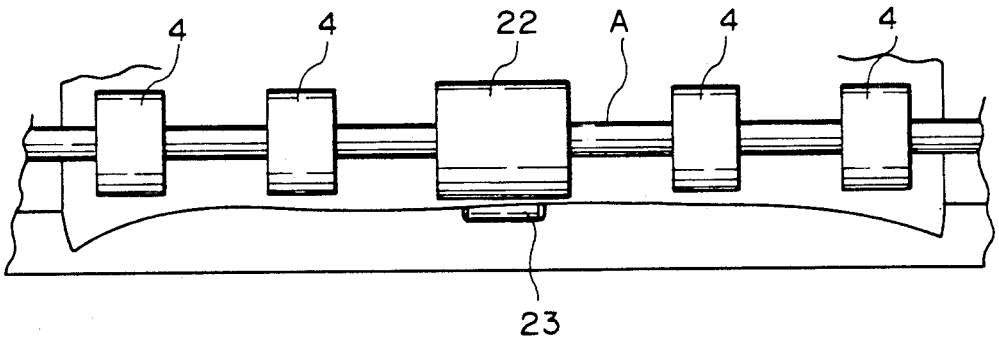
Fig. 7 PRIOR ART
FIG. 7 is a view showing how a paper sheet is driven by a feed roller, as viewed from the intermediate tray side.
Figure 8:
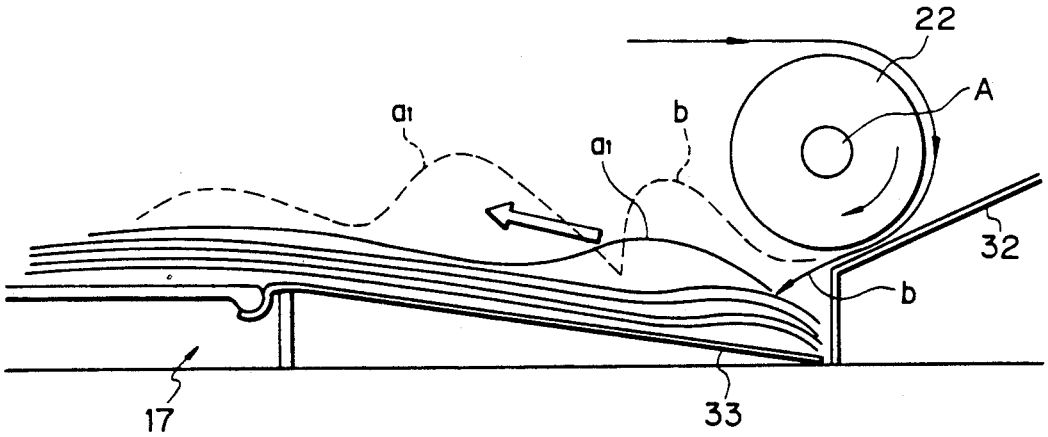
Fig. 8 PRIOR ART
FIG. 8 shows a specific condition in which a paper sheet is driven into an intermediate tray.
Figure 11:
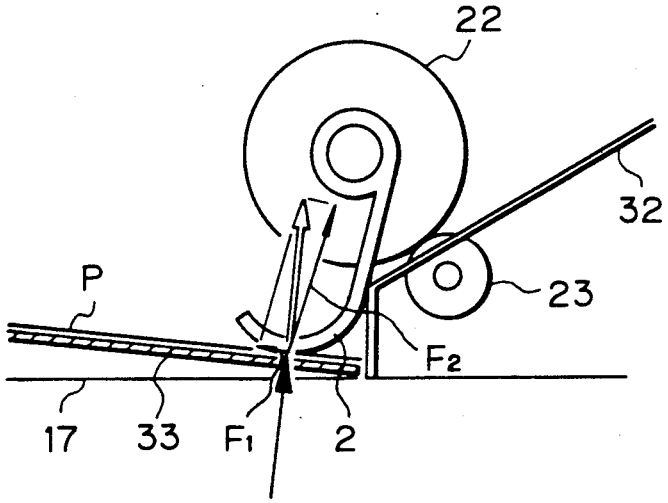
Fig. 11 PRIOR ART
FIGS. 11 and 12 are views demonstrating drawbacks particular to the prior art.
Figure 12:
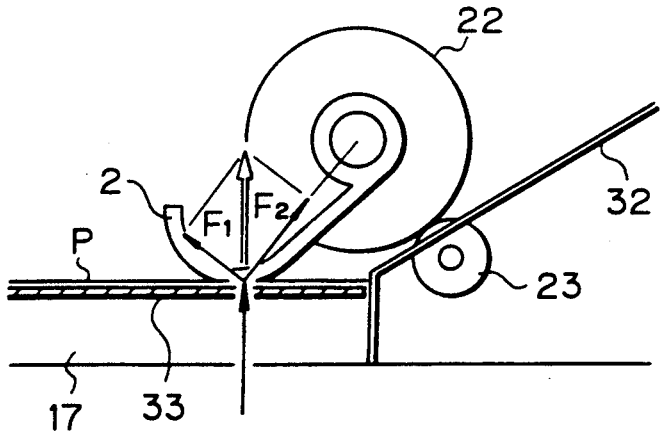
Fig. 12 PRIOR ART

FIGS. 11 and 12 indicate disadvantages particular to the paper pressing member 2 of the conventional arrangement. As shown, when the bottom plate 33 is raised, a component force acts on the paper pressing member 2. As shown in FIG. 11, when the component force $F_1$ is small and the coefficient of friction between the member 2 and the paper sheet P is large, the bottom plate 33 is prevented from rising and is thereby locked in position. In previously mentioned Laid-Open Publication No. 154541/1988, the elastic piece 6 is located at the center of a one-sided paper sheet, i.e., in a position corresponding to the rollers 22 and 23. In such a configuration, a paper sheet to be stacked on the intermediate tray 17 enters the tray 17 with the center of its leading edge being raised, as shown in FIGS. 5 and 7, and with opposite side edges of the same being lowered, as shown in FIGS. 6 and 7. When such a paper sheet entering the tray 17 has a back curl, the side edges thereof will be further lowered. As shown in FIG. 8, the paper sheet with a back curl forces a copy sheet $a_1$ already stacked on the tray 17 to a position indicated by a dashed line in the figure, resulting in incomplete stacking. To eliminate this incomplete stacking, the bottom plate 33 and the paper releasing position of the tray 17 may be spaced apart by a sufficient distance for preventing the leading edge of the following sheet to contact the trailing edge of the preceding sheet. However, such a distance would increase the overall height of the copier to degrade the manipulability and would cause the space-saving feature particular to a reversible feed roller type scheme to be lost.

Preferred embodiments of the present invention will be described hereinafter. In the figures, the same or similar components and structural elements are designated by like reference numerals, and redundant description will be avoided for simplicity.

Figure 13:
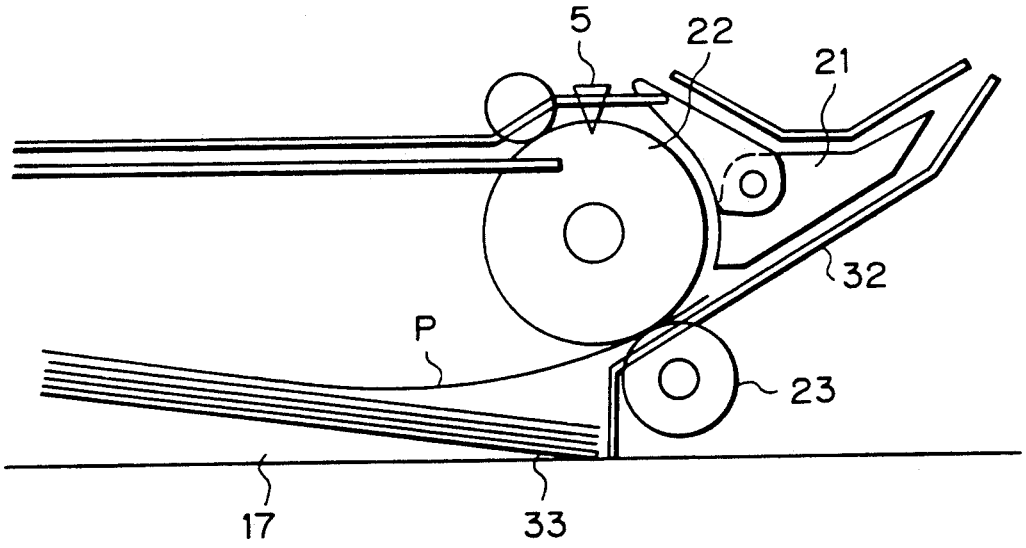
FIG. 13 is a fragmentary view showing a paper refeeding device embodying the present invention.

Referring to FIG. 13, a paper refeeding device embodying the present invention is shown. As shown, a sensor 5 for sensing a paper sheet P directed toward an intermediate tray 17 is disposed above a feed roller 22. Specifically, the sensor 5 senses the trailing edge of a single paper sheet P in a single two-side copy mode operation or the trailing edge of the last paper sheet P in a multiple two-side copy mode operation. When the sensor 5 has sensed a paper sheet P, it delivers an output thereof to a controller, not shown. In response, the controller delivers a command for stopping the rotation of the feed roller 22 at a predetermined timing. The words "predetermined timing" refer to the time when the leading edge of the paper sheet P is nipped by the feed roller 22 and separator roller 23 and is clear of an upper guide 21, as shown in FIG. 13. Since the paper sheet P has been continuously nipped by the rollers 22 and 23, it can be positioned without resorting to a side plate or similar extra member. In this position, the paper sheet P is refed into a copier body 1.

It will be seen that the illustrative embodiment eliminates the need for a positioning operation otherwise effected by the presser plate 35 and side plate 36 and an operation for urging a paper stack against the feed roller 22 otherwise performed by the bottom plate 33 (see FIG. 2). This is successful in reducing the refeeding time and, therefore, the overall copying time.

Figure 14:
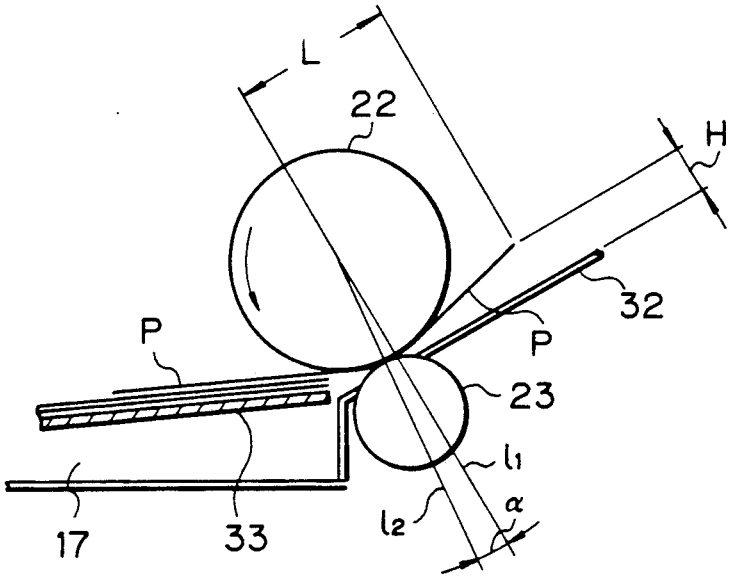
FIG. 14 is a fragmentary view showing an alternative embodiment of the present invention.
Figure 15:
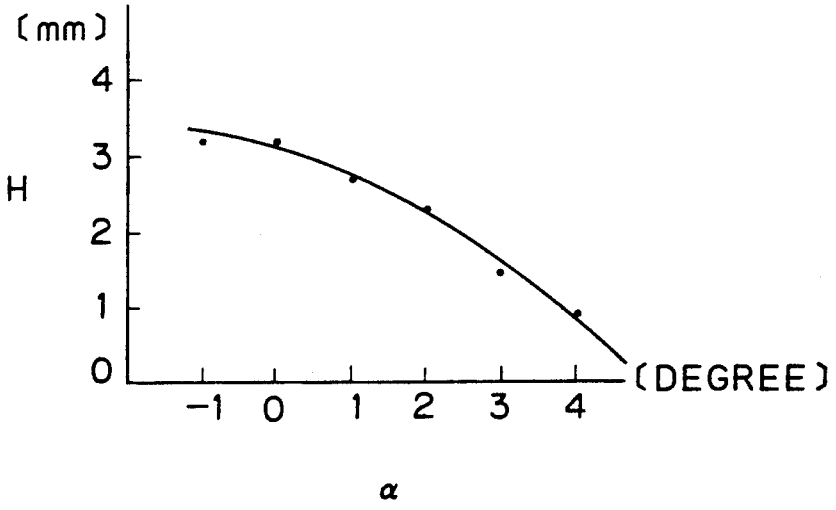
FIG. 15 is a graph representative of a characteristic particular to the embodiment shown in FIG. 14.

Referring to FIGS. 14 and 15, an alternative embodiment of the present invention will be described. As shown, the axis of the separator roller 23 is positioned closer to the intermediate tray 17 than a perpendicular $l_1$ which extends from the feed roller 22 to the guide plate 32. This deviation represented by an angle $\alpha$ between the perpendicular $l_1$ and a line $l_2$ interconnecting the axes of the rollers 22 and 23 is selected to lie in the range of 2 to 4 degrees. In FIG. 14, L shows the distance defined between the perpendicular $l_1$ and the trailing edge of the paper sheet P when the leading edge of the sheet P has been nipped by the rollers 22 and 23, while H shows the height as measured from the guide 32 (lift). As the height H decreases, the paper sheet P is nipped more smoothly by the rollers 22 and 23 and thereby prevented from slipping. In FIG. 15, the ordinate and abscissa indicate the angle $\alpha$ (degree) and height H (millimeter), respectively. The advantage of the configuration shown in FIG. 14 is more prominent when the angle $\alpha$ is greater than 2 degrees.

Figure 16:
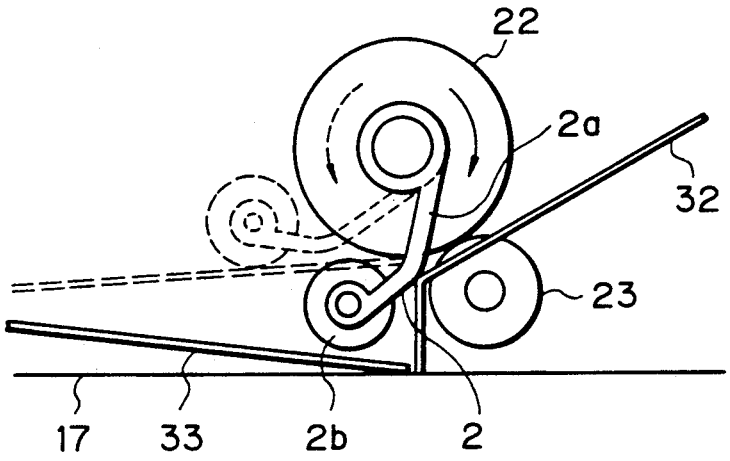
FIG. 16 is a view showing another alternative embodiment of the present invention.

FIG. 16 shows another alternative embodiment of the present invention which has an improved paper pressing member 2. As shown, the paper pressing member 2 has a guide portion 2*a* for guiding the leading edge of a paper sheet P, and a rotatable pressing portion 2*b* for pressing the trailing edge of the sheet P entered the intermediate tray 17. The rotatable pressing portion 2*b* may be implemented with a roller by way of example. In this configuration, the pressing portion 2*b* rotates and thereby allows the bottom plate 33 to rise without being locked in position.

Figure 17:
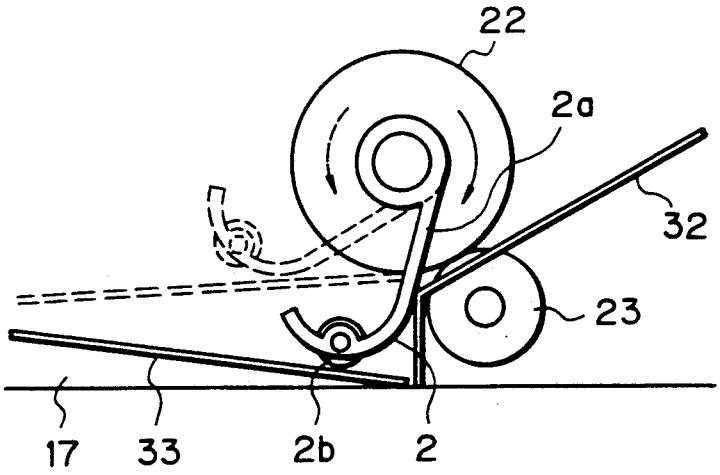
FIG. 17 is a view showing a modified form of the embodiment shown in FIG. 16.

FIG. 17 shows a modified form of the paper pressing member 2 depicted in FIG. 16. While the pressing portion 2*b* shown in FIG. 16 is implemented with a roller having a relatively large diameter and constantly held in contact with the bottom plate 33, the pressing portion 2*b* shown in FIG. 17 is implemented with a roller having a relatively small diameter. Such a small roller contacts the bottom plate 33 only in the initial stage of the rise of the bottom plate 33, i.e., only when the component force for causing rotation is comparatively small. Even this configuration successfully prevents the bottom plate 33 from being locked.

As stated above, the embodiment shown in FIGS. 14 and 15 insures a margin as to slippage when a paper sheet P enters the intermediate tray 17 and prevents the sheet P to be refed from abutting against the guide. The embodiment shown in FIG. 16 and its modification shown in FIG. 17 prevent the bottom plate 33 from being locked in position since the pressing portion 2*b* is rotatable.

FIGS. 18A to 18D and 19A and 19B show another alternative embodiment of the present invention. Referring again to FIG. 1, the copier to which the various embodiments of the present invention are applicable has a paper cassette 10, a paper feeding device 11 for feeding paper sheets one by one from the cassette 10, a register roller 12 for driving the paper sheet at a predetermined timing, a photoconductive drum 13, an image transferring unit 14, a fixing unit 15, a roller 16 for driving a paper sheet or copy onto a copy tray, not shown, the intermediate tray 17, and the selector 18 actuated by a solenoid, not shown, for selectively steering a paper sheet toward the copy tray or the intermediate tray 17. A second selector in the form of a pawl 21 is also actuated by a solenoid, not shown, to assume either one of two different positions. The feed roller 22 is reversible, as stated earlier. The separator roller 23 is mounted on a shaft 24 which is mounted on a rotatable arm 25. A tension spring 26 constantly biases the arm 25 in a direction for urging the separator roller 23 against the feed roller 22. When the feed roller 22 is rotated in a direction for feeding a copy sheet into the intermediate tray 17, the separator roller 23 is caused to follow the movement of the roller 22 by the one-way clutch, as stated previously. In the event of refeed, the separator roller 23 is held in a halt for allowing paper sheets to be fed one at a time.

As shown in FIGS. 18A to 18D, auxiliary rollers 28 are mounted on the shaft 27 in a symmetric relation with respect to the feed roller 22. The auxiliary rollers 28 each has a smaller diameter than the feed roller 22. An elastic guide member 29 is located to face the feed roller 22 and constituted by, for example, an about 0.2 millimeter thick Mylar sheet. The guide member 29 is affixed to a support member 30 at the lower end thereof and held in contact with the auxiliary rollers 28 at the upper end 29*a* thereof. When the auxiliary rollers 28 are rotated clockwise, the upper end 29*a* of the guide member 29 is located inside of the wall 17*a* of the intermediate tray 17 following the movement of the rollers 28. The support member 30 is rotatably mounted on a shaft 31. When the feed roller 22 and, therefore, the auxiliary rollers 28 are rotated counterclockwise, the upper end 29*a* of the guide member 29 is moved out of the tray 17 following the movement of the rollers 28. At the same time, the support member 30 is rotated clockwise about the shaft 31 thereof. The lower end 30*a* of the support member 30 is bent and protrudes into the tray 17 through an opening formed in the wall 17*a*. The upper end 30*b* of the support member 30 is bent in the opposite direction to the lower end 30*a* and, in the stacking condition shown in FIG. 18A, has a bend 30*c* thereof protruding upward through an opening 32*a* formed in the guide plate 32. The bend 30*c* guides the leading edge of the incoming paper sheet to prevent it from entering the joining portion of the guide member 29 and support member 30.

The rotation of the support member 30 is also interlocked with the movement of the bottom plate 33 which urges paper sheets stacked on the tray 17 against the feed roller 22. Pushing means 34, FIG. 2, pushes the bottom plate 33 only when refeed is under way. Specifically, the lower end 30*a* of the support member 30 is positioned below the bottom plate 33. As the bottom plate 33 is lowered to a stacking position thereof, it presses down the end 30*a* of the support member 30 and thereby rotates the support member 30 counterclockwise and retains it. On the other hand, when the bottom plate 33 is raised in the event of refeed, the support member 30 is relased from the bottom plate 33 and is caused to tilt by the guide member 29 which follows the movement of the auxiliary rollers 28. An end plate 35, FIG. 2, stops the leading edge of a paper sheet entering the tray 17 and is partly inclined toward the paper inlet side, as illustrated. The end plate 35 is set at a particular position matching the paper size beforehand. A side plate 36, FIG. 2, positions a paper sheet in the widthwise direction of the latter. More specifically, the side plate 36 regulates the position of a paper sheet in the event of stacking and prevents it from skewing in the event of refeeding. A second register roller 37, FIG. 2, stops a paper sheet refed from the tray 17 and then drives it again toward the register roller 12. A guide member implemented with a Mylar sheet, for example, is positioned to face the feed roller 22 to raise the intermediate portion of the leading edge of a paper sheet.

Figure 18A:
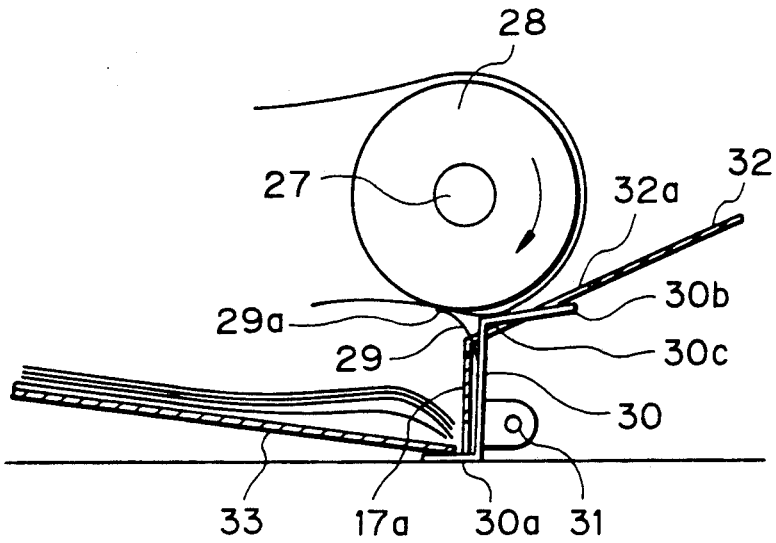
FIGS. 18A to 18D are views showing another alternative embodiment of the present invention in different operating positions.

The operation of the illustrative embodiment will be described with reference to FIGS. 18A to 18D. As shown in FIG. 18A, a one-sided paper sheet to be stacked on the intermediate tray 17 is driven by the feed roller 22 and auxiliary rollers 28 into the tray 17. In this stage of operation, the bottom plate 33 remains in the lowered position and presses the lower end 30*a* of the support member 30. Hence, the support member 30 is held in an upright position with the bend 30*c* thereof protruding from the opening 32*a* of the guide plate 32. The upper end 29*a* of the guide member 29 which is affixed to the support member 30 follows the clockwise movement of the auxiliary rollers 28 and, therefore, assumes a position inside of the wall 17*a*. In this condition, the guide member 29 contacts the auxiliary rollers 28 on a leftwardly upwardly inclined tangential line. The bend 30*c* of the support member 30 guides the leading edge of the incoming paper sheet into the plane where the upper end 29*a* of the guide member 29 and the auxiliary rollers 28 contact each other. Extending upward, the end 29*a* of the guide member 29 urges the leading edge of the paper sheet upward while releasing it into the tray 7. Further, the end 29*a* of the guide member 29 presses the paper sheet against the auxiliary rollers 28 to thereby generate a transporting force, so that the paper sheet is more surely driven into the tray 17.

Figure 18B:
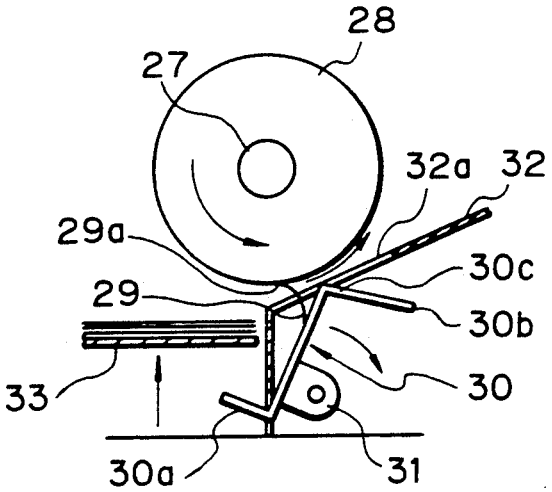
Figure 18C:
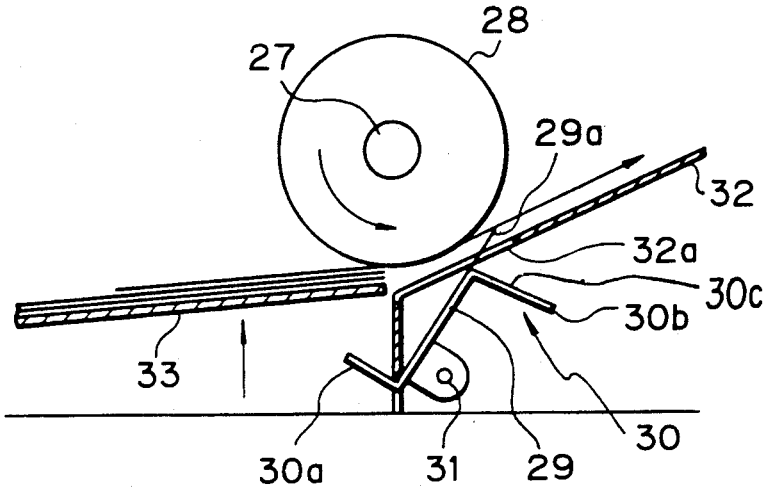

In the event of refeed, the auxiliary rollers 28 are rotated counterclockwise, and the pushing means 34 is released to raise the bottom plate 33, as shown in FIG. 18B. Then, the support member 30 is released from the bottom plate 33 and thereby rendered tiltable. As the end 29*a* of the guide member is shifted to the right following the counterclockwise rotation of the auxiliary rollers 23, the support member 30 is tilted to the right. When the bottom plate 33 is further raised until it presses the upper rear end of the paper stack against the feed roller 22, the resulting pressure and the counterclockwise rotation of the feed roller 22 generate a transporting force. As a result, the paper sheets on the tray 17 are refed one by one. At this instant, the separator roller 23 held in contact with the feed roller 22 is prevented from following the rotation of the feed roller 22 by the one-way clutch associated therewith, insuring the refeed of one paper sheet at a time. While the paper stack is pressed against the feed roller 22 as mentioned, it is not pressed against the auxiliary rollers 28, as shown in FIG. 18C. Hence, the refeed is executed only by the transporting force generated by the feed roller 22. In the tilted position of the support member 30, the lower end 30*a* is stopped by the upper edge of the opening of the wall 17*a*. The upper end 29*a* of the guide member 29 held in a position spaced apart from the auxiliary rollers 28 and retracted from the refeed path.

Figure 18D:
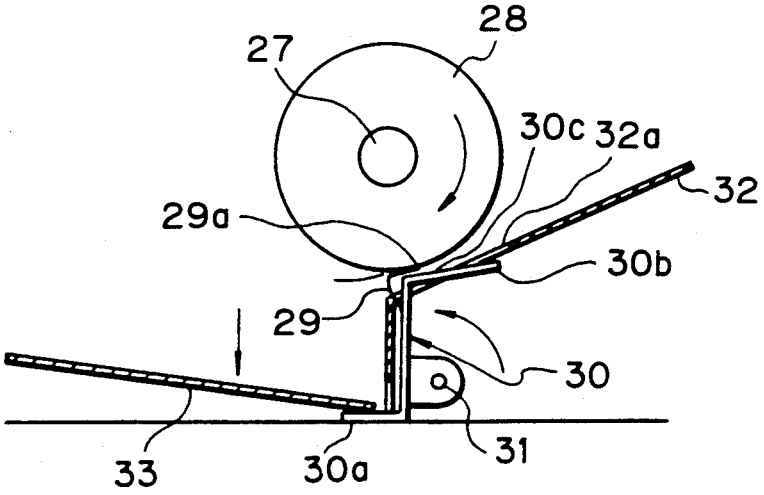
Figure 19A:
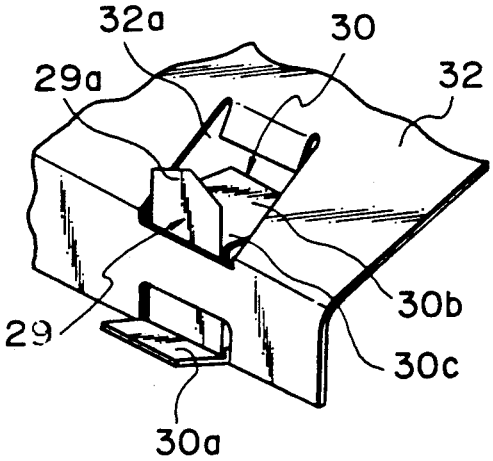
FIGS. 19A and 19B are view showing a guide member and a support member associated with a guide plate of the embodiment shown in FIGS. 18A to 18D.
Figure 19B:
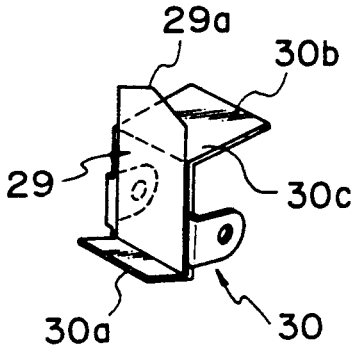

When paper sheets are to be stacked again on the intermediate tray 17, the auxiliary rollers 28 and feed roller 22 are again rotated clockwise, as shown in FIG. 18D. The pushing means 33 presses down the lower end 30*a* of the support member 30 to restore the support member 30 to the upright position, as indicated by an arrow in FIG. 18D. Then, the upper end 29*a* of the guide member 29 is caused into contact with the auxiliary rollers 28 and is returned to the inside of the wall 17*a* by following the rotation of the rollers 28. As a result, the condition shown in FIG. 18A is set up again.

As stated above, the illustrative embodiment has the guide member 29 facing the feed roller 22 and auxiliary rollers 28 and thereby directs the leading edge of an incoming paper sheet upward. Hence, despite that the line interconnecting the axes of the rollers 22 and 23 is inclined to lower the leading edge of an incoming paper sheet, the guide member 29 urges the leading edge of the sheet upward to prevent it from contacting the trailing edge of the paper sheets already stacked on the tray 17. This not only insures stable stacking but also reduces the overall thickness of the tray 17 and, therefore, the overall height of the copier. In the event of refeed, as the support member 30 tilts, the guide member 29 facing the auxiliary rollers 28 is retracted from the refeed path. In such a condition, despite that the paper sheets are driven only by the feed roller 22 due to the stop of rotation of the separator roller 23 and are therefore apt to skew, the end of the guide member 29 does not contact the paper sheet being refed and, therefore, frees it from forces that would cause skew. As a result, the paper sheets are stably refed one by one out of the tray 17.

The guide member 29 implemented with a Mylar sheet urges a paper sheet against the auxiliary rollers 28 with the end 29*a* thereof to thereby generate a transporting force, promoting positive feed of the sheet into the tray 17. The support member 30 is rotatable in interlocked relation to the reversible rotation of the auxiliary rollers 28. Since the angular movement of the support member 30 occurs in association with the rise and fall of the bottom plate 33, a solenoid or similar actuator for moving the support member 30 and which would complicate the construction is not needed. The bend 30*c* of the support member 30 protrudes upward through the opening 32*a* of the guide plate 32 in the event of stacking, preventing an incoming paper sheet from being caught by the joining portion of the guide member 29 and support member 30. Further, at the time of refeed, the support member 30 is tilted away from the refeed path to prevent the bend 30*c* thereof from interfering with a paper sheet being refed.

Figure 20:
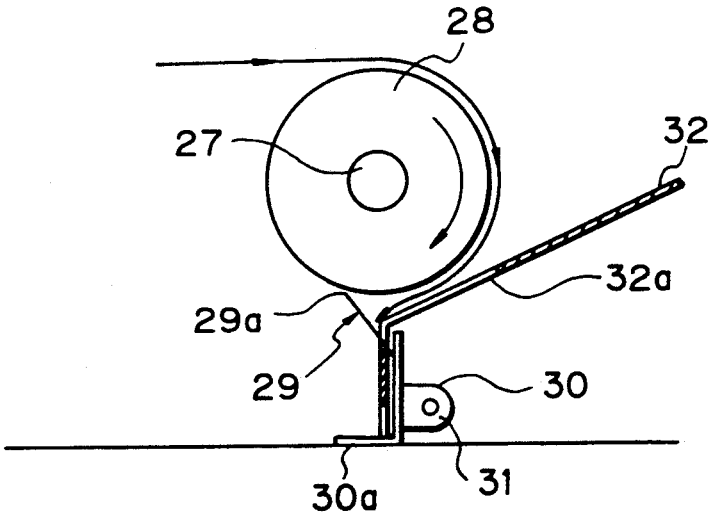
FIG. 20 is a view showing another alternative embodiment of the present invention.

FIG. 20 shows another alternative embodiment of the present invention. As shown, this embodiment differs from the embodiment shown in FIGS. 18A to 19B in that the support member 30 lacks the bend 30*c* and upper end portion 30*b*, i.e., it extends straight to a position just below the opening 32*c* of the guide plate 32.

Figure 21:
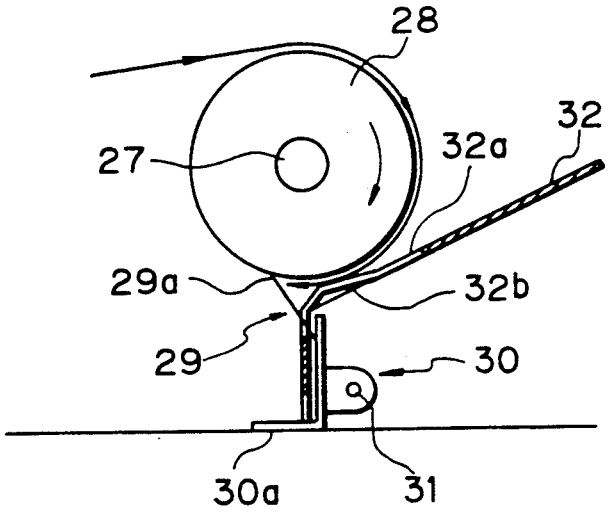
FIG. 21 is a view showing another alternative embodiment of the present invention.
Figure 22:
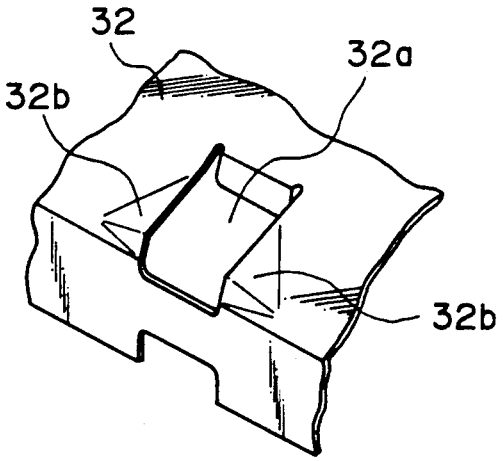
FIG. 22 is a fragmentary view of a guide plate included in the embodiment of FIG. 21.

FIGS. 21 and 22 depict another alternative embodiment of the present invention which is essentially similar to the embodiment of FIG. 20 except that the guide 32 has upward projections 32*b* at opposite sides of the opening 32*a*. In this configuration, a paper sheet to be stacked on the tray 17 abuts against the projections 32*b* and is thereby guided toward the position where the leading edge 29*a* of the guide member 29 and the auxiliary rollers 28 contact. This is also successful in preventing the paper sheet from being caught by the joining portion of the guide member 29 and support member 30.

Figure 23:
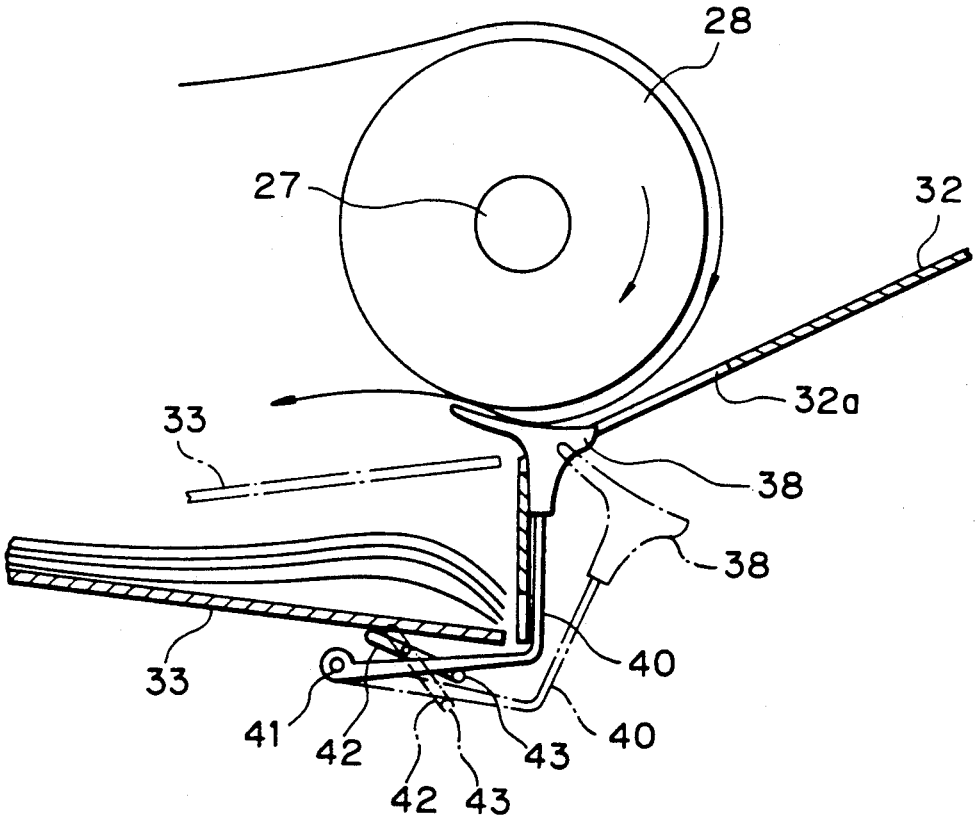
FIG. 23 is a view showing another alternative embodiment of the present invention.

Referring to FIG. 23, another alternative embodiment of the present invention is shown and has a guide member 38 which is not elastic. In the event of stacking, the non-elastic guide member 38 does not contact the auxiliary rollers 28. Specifically, the guide member 38 is affixed to an arm 40 which is in turn rotatably mounted on a shaft 41 at one end thereof. The arm 40 is interlocked with the bottom plate 33 by a lever 42 which is rotatably mounted on a shaft 41. The lever 42 has an engaging portion 43 which is engaged with the underside of the arm 40. In operation, at the time of stacking, the bottom plate 33 is held in the lowered position with the arm 40 and guide member 38 being held in the positions indicated by solid lines in the figure via the lever 42. In this condition, the leading edge of an incoming paper sheet is guided upward by the upper surface of the guide member 38 and then discharged into the tray 17 through between the member 38 and the auxiliary rollers 28. At the time of refeed, the bottom plate 33 is raised as in the previous embodiments. Then, the guide member 38 and arm 40 are rotated clockwise about the shaft 41 due to gravity or a biasing force exerted by a spring or similar biasing means. As a result, the guide member 38 and arm 40 are retracted to below the guide plate 32, as indicated by dash-and-dot lines in the figure. If desired, the guide member 38 may be provided with rollers at the left end thereof as viewed in the figure and hold them in contact with the auxiliary rollers 28.

As stated above, the embodiments shown in FIGS. 18A to 23 allow an incoming paper sheet to reach the intermediate tray 17 without abutting against the trailing edge of the paper sheets already stacked on the tray 17. This is achievable without increasing the overall height of the copier.

In summary, in accordance with the present invention, when images are to be reproduced on both sides of a single paper sheet, the trailing edge of the paper sheet is nipped by a feed roller and a separator roller. This eliminates the need for positioning operations heretofore performed by a pressure plate and a side plate and thereby reduces the interval between the stacking step and the refeeding step, whereby the overall copying time is reduced. This is also true with the last one of a multiple paper sheets.

The separator roller is positioned closer to an intermediate tray than a perpendicular extending from the axis of the feed roller to a guide plate. This insures a margin as to the slippage of an incoming paper sheet. In the event of refeed, a paper sheet is stably transported without abutting against an upper guide.

A paper pressing device has a rotatable pressing portion. When a bottom plate is raised in the event of refeed, the rotatable pressing portion allows the bottom plate to rise without being locked in position by the friction between itself and the paper sheets. Hence, paper sheets can be refed without any error.

Furthermore, paper sheets can be sequentially stacked on the intermediate tray without the overall height of equipment being increased. Since a guide member retracts from a refeed path in the event of refeed, it promotes stable paper feed free from skew. Since the retraction of the guide member is interlocked with the up-and-down movement of the bottom plate, it does not need any extra driving means. This not only simplifies the construction but also implements automatic timing control. The guide member may simply be constituted by a Mylar sheet.

Various modifications will become possible for those skilled in the art after receiving the teachings of the present disclosure without departing from the scope thereof.

What is claimed is:

1. A paper refeeding device for a copier operable in a two-sided copy mode, comprising:

an intermediate tray for stacking one-sided paper sheets each carrying an image on one side thereof;

a feed roller selectively rotatable in a direction for driving one-sided paper sheets into said intermediate tray and a direction for driving said one-sided paper sheets out of said intermediate tray;

a separator roller contacting said feed roller; and a sensor for sensing, when images are to be reproduced on both sides of a plurality of paper sheets, sensing a last one of said plurality of paper sheets to be driven into said intermediate tray and then generating a signal which causes said feed roller and said separator roller to stop driving said last paper sheet while nipping the trailing edge of said last paper sheet therebetween.

2. A paper refeeding device for a copier operable in a two-sided copy mode, comprising:

an intermediate tray for stacking one-sided paper sheets each carrying an image on one side thereof;

a feed roller selectively rotatable in a direction for driving one-sided paper sheets into said intermediate tray and a direction for driving said one-sided paper sheets out of said intermediate tray; and a paper pressing member rotatably disposed above said intermediate tray and having a rotatable pressing portion for pressing the trailing edge of a one-sided paper sheet driven into said intermediate tray.

3. A paper refeeding device for a copier operable in a two-sided copy mode, comprising:

an intermediate tray for stacking one-sided paper sheets each carrying an image on one side thereof;

a feed roller selectively rotatable in a direction for driving one-sided paper sheets into said intermediate tray and a direction for driving said one-sided paper sheets out of said intermediate tray, by using the center of each of said one-sided paper sheets as a reference;

a separating roller contacting said feed roller;

auxiliary rollers arranged in a symmetrical relation with respect to said feed roller and reversibly rotatable in association with said feed roller;

a line interconnecting the axes of said feed roller and said separator roller being inclined such that a one-sided paper sheet is directed substantially downwardly into said intermediate tray and, in the event of refeed, separated from the other one-sided paper sheets with an upper portion thereof contacting said feed roller; and a guide member facing said feed roller and said auxiliary rollers which are located at opposite ends;

said guide member urging the leading edge of a one-sided paper sheet upward when said one-sided paper sheet is driven into said intermediate tray.

4. A device as claimed in claim 3, wherein said guide member comprises a Mylar sheet.

5. A device as claimed in claim 4, wherein said guide member is retractable from a transport path along which a one-sided paper sheet is to be transported, in interlocked relation to up-and-down movement of a bottom plate which presses against said feed roller to generate a feed pressure.

* * * * *